US011085637B2

(12) United States Patent
Isono et al.

(10) Patent No.: US 11,085,637 B2
(45) Date of Patent: Aug. 10, 2021

(54) GAS TURBINE COMBUSTOR AND GAS TURBINE ENGINE INCLUDING SAME

(71) Applicant: MITSUBISHI HEAVY INDUSTRIES, LTD., Tokyo (JP)

(72) Inventors: Mitsunori Isono, Tokyo (JP); Keijiro Saito, Tokyo (JP); Shuhei Hosaka, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 164 days.

(21) Appl. No.: 16/299,516

(22) Filed: Mar. 12, 2019

(65) Prior Publication Data

US 2019/0293287 A1 Sep. 26, 2019

(30) Foreign Application Priority Data

Mar. 26, 2018 (JP) ..... JP2018-058232

(51) Int. Cl.
*F23N 5/24* (2006.01)
*F23R 3/46* (2006.01)
(Continued)

(52) U.S. Cl.
CPC ..... *F23N 5/24* (2013.01); *F23D 14/58* (2013.01); *F23D 14/70* (2013.01); *F23N 5/26* (2013.01); *F23R 3/46* (2013.01)

(58) Field of Classification Search
CPC . F23D 14/58; F23D 14/70; F23N 5/24; F23N 5/26; F23R 2900/00014; F23R 3/286; F23R 3/343; F23R 3/46
See application file for complete search history.

(56) References Cited

U.S. PATENT DOCUMENTS 6,122,916 A * 9/2000 Amos ..... F23D 23/00 60/747
2009/0139240 A1* 6/2009 Rackwitz ..... F23D 11/107 60/740

(Continued)

FOREIGN PATENT DOCUMENTS

DE 102007043626 3/2009
DE 102011055109 5/2012

(Continued)

OTHER PUBLICATIONS

Japanese Office Action dated Feb. 4, 2020 in corresponding Japanese Patent Application No. 2018-058232 with Machine Translation.

(Continued)

*Primary Examiner* — Jorge A Pereiro
*Assistant Examiner* — Logan P Jones
(74) *Attorney, Agent, or Firm* — Wenderoth, Lind & Ponack, L.L.P.

(57) ABSTRACT

A gas turbine combustor includes a pilot burner disposed on a central portion of a combustion liner; and a plurality of main burners disposed to surround the pilot burner. The pilot burner includes: a pilot nozzle disposed on the central portion of the combustion liner; and a pilot cone including a widened portion widening downstream away from a downstream end of the pilot nozzle, and an annular portion having an annular shape extending outward in a radial direction from a downstream opening end of the widened portion. The annular portion includes a first position in a circumferential direction and a second position different from the first position in the circumferential direction, and the first position and the second position have different widths in the radial direction.

13 Claims, 12 Drawing Sheets

(51) Int. Cl.

| | |
|---|---|
| ***F23N 5/26*** | (2006.01) |
| ***F23D 14/58*** | (2006.01) |
| ***F23D 14/70*** | (2006.01) |
| ***F23R 3/28*** | (2006.01) |
| ***F23R 3/34*** | (2006.01) |
| ***F23R 3/10*** | (2006.01) |
| ***F23R 3/14*** | (2006.01) |

(56) References Cited

U.S. PATENT DOCUMENTS

| | | | | |
|---|---|---|---|---|
| 2010/0050644 | A1 | 3/2010 | Pidcock et al. | |
| 2011/0048022 | A1 | 3/2011 | Singh et al. | |
| 2012/0111013 | A1 | 5/2012 | Parsania et al. | |
| 2012/0174588 | A1 | 7/2012 | Rackwitz et al. | |
| 2013/0125550 | A1* | 5/2013 | Prade | F23R 3/343 60/740 |
| 2015/0300648 | A1* | 10/2015 | Saito | F23R 3/286 60/737 |
| 2016/0209040 | A1 | 7/2016 | Tamura et al. | |
| 2017/0122563 | A1* | 5/2017 | Tanaka | F23R 3/343 |
| 2019/0086089 | A1 | 3/2019 | Takiguchi et al. | |

FOREIGN PATENT DOCUMENTS

| | | |
|---|---|---|
| DE | 112015002441 | 3/2017 |
| DE | 112017001173 | 11/2018 |
| JP | 11-344224 | 12/1999 |
| JP | 2003-517553 | 5/2003 |
| JP | 2011-47401 | 3/2011 |
| JP | 2015-68538 | 4/2015 |
| JP | 2017-161087 | 9/2017 |

OTHER PUBLICATIONS

The Office Action dated Mar. 31, 2020 in counterpart CN application No. 201910219887.6 with Machine translation.

* cited by examiner

GAS TURBINE COMBUSTOR AND GAS TURBINE ENGINE INCLUDING SAME

TECHNICAL FIELD

This disclosure relates to a gas turbine combustor and a gas turbine engine including the same.

BACKGROUND ART

Conventionally, a premixed combustion type of gas turbine combustor including a pilot burner disposed on a central portion of a combustion liner and a plurality of main burners surrounding the pilot burner is known. Such a premixed combustion type of gas turbine combustor causes periodic pressure fluctuation in the combustor by combustion, which can cause so-called combustion oscillation upon coincidence between the cycle of the pressure fluctuation coincides and the acoustic natural frequency of the combustor. The combustion oscillation makes combustion unstable and causes problems such as damage to the combustor due to combustion pressure fluctuation.

In view of the above problems, for instance, JP 2011-47401A discloses that main nozzles are arranged in the combustion cylinder irregularly in the circumferential direction of the combustion liner so as to ignite and combust a premixed gas supplied from the main nozzles at the same position in the axial direction of the combustor; this configuration attempts to prevent concentration of the heat generation position due to injection flame and suppress combustion oscillation.

SUMMARY

In terms of manufacturing, control and maintenance of a gas turbine, it is preferable that main burners are arranged uniformly in the axial direction in a symmetrical manner about the axis in the combustion liner. Therefore, there is demand for a configuration which prevents and suppresses combustion oscillation while keeping symmetry and uniformity of the arrangement of the main burners.

In view of the above, an object of at least one embodiment of the present invention is to prevent the occurrence of combustion oscillation while maintaining symmetry of the arrangement of main burners.

(1) According to at least one embodiment of the present disclosure, a gas turbine combustor comprises: a pilot burner disposed on a central portion of a combustion liner; and a plurality of main burners disposed to surround the pilot burner. The pilot burner includes: a pilot nozzle disposed on the central portion of the combustion liner; and a pilot cone including a widened portion widening downstream from a vicinity of a downstream end of the pilot nozzle, and an annular portion having an annular shape extending outward in a radial direction from a downstream opening end of the widened portion. The annular portion includes a first position in a circumferential direction and a second position different from the first position in the circumferential direction, and the first position and the second position have different widths in the radial direction.

With the above configuration (1), since the width of the annular portion of the pilot cone in the radial direction varies between the first position and the second position in the circumferential direction, a mixture position where pilot flame injected from the pilot nozzle and guided downstream along the inner periphery of the pilot cone is mixed with main fuel injected from the main burner varies in the direction of the central axis of the combustion liner, depending on the width of the annular portion. That is, if the width of the annular portion is wide, pilot flame and main fuel are mixed at a more downstream position; and if the width of the annular portion is narrow, pilot flame and main fuel are mixed at a more upstream position. Accordingly, with the above configuration (1), the flame holding position at different sites (phases) in the circumferential direction can be dispersed in the axial direction. Thus, it is possible to prevent the flame holding position from concentrating on a certain position in the axial direction while maintaining symmetry of the arrangement of the main burners, and it is possible to suppress combustion oscillation.

(2) In some embodiments, in the above configuration (1), a center of an outer periphery of the annular portion of the pilot cone may coincide with a central axis of the combustion liner, and a center of an inner periphery of the annular portion may deviate from the central axis of the combustion liner.

With the above configuration (2), since the inner periphery of the annular portion is eccentric with respect to the outer periphery of the annular portion which is concentric with the central axis of the combustion liner, the width of the annular portion varies with position in the circumferential direction, which enables dispersion of the flame holding position in the axial direction. Accordingly, it is possible to suppress combustion oscillation while maintaining symmetry of the arrangement of the main burners.

(3) In some embodiments, in the above configuration (1) or (2), at least an outer periphery of the annular portion of the pilot cone may be elliptical when viewed from a direction of a central axis of the combustion liner so that a width of the annular portion in the radial direction varies in the circumferential direction.

With the above configuration (3), since at least the outer periphery of the annular portion is elliptical when viewed from the direction of the central axis of the combustion liner, the width of the annular portion varies in the circumferential direction, and the flame holding position is dispersed in the axial direction. Accordingly, it is possible to suppress combustion oscillation while maintaining symmetry of the arrangement of the main burners.

(4) In some embodiments, in the above configuration (1), the pilot nozzle may be disposed eccentrically with respect to a central axis of the combustion liner, and the pilot cone may be disposed so that a center of an outer periphery of the annular portion coincides with the central axis of the combustion liner, and a center of an inner periphery of the annular portion deviates from the central axis of the combustion liner.

With the above configuration (4), since the center of the outer periphery of the annular portion coincides with the central axis of the combustion liner while the center of the inner periphery of the annular portion deviates from the central axis of the combustion liner, the width of the annular portion varies in the circumferential direction, and the flame holding position is dispersed in the axial direction. Accordingly, it is possible to suppress combustion oscillation while maintaining symmetry of the arrangement of the main burners.

(5) In some embodiments, in the above configuration (4), the inner periphery of the annular portion may be concentric with the pilot nozzle.

Also with the above configuration (5), it is possible to suppress combustion oscillation while maintaining symmetry of the arrangement of the main burners.

(6) In some embodiments, in any one of the above configurations (1) to (5), the pilot cone may include a cylindrical portion disposed around the pilot nozzle and extending upstream from an upstream end of the widened portion, and the pilot nozzle may be disposed eccentrically with respect to the cylindrical portion.

With the above configuration (6), the pilot nozzle is disposed eccentrically with respect to the cylindrical portion disposed upstream of the widened portion. Thus, fuel injected from the pilot nozzle is guided asymmetrically to the inner periphery of the widened portion and mixed with fuel injected from each main nozzle, at an asymmetric position with respect to the central axis of the combustion liner. Accordingly, it is possible to disperse the flame holding position around the axis and in the axial direction, and thus it is possible to suppress combustion oscillation while maintaining symmetry of the arrangement of the main burners.

(7) In some embodiments, in the above configuration (6), a center of the cylindrical portion of the pilot cone may coincide with a central axis of the combustion liner.

With the above configuration (7), the pilot nozzle which is eccentric with respect to the center of the cylindrical portion is disposed eccentrically with respect to the central axis of the combustion liner. Thus, fuel injected from the pilot nozzle is guided asymmetrically to the inner periphery of the widened portion and mixed with fuel injected from each main nozzle, at an asymmetric position with respect to the central axis of the combustion liner. Accordingly, it is possible to disperse the flame holding position around the axis and in the axial direction, and thus it is possible to suppress combustion oscillation while maintaining symmetry of the arrangement of the main burners.

(8) In some embodiments, in the above configuration (6), the pilot nozzle may be disposed concentrically with a central axis of the combustion liner.

With the above configuration (8), at least the cylindrical portion of the pilot cone is disposed eccentrically with respect to the pilot nozzle which is concentric with the central axis of the combustion liner. Thus, fuel injected from the pilot nozzle is guided asymmetrically to the inner periphery of the widened portion and mixed with fuel injected from each main nozzle at an asymmetric position with respect to the central axis of the combustion liner. Accordingly, it is possible to disperse the flame holding position around the axis and in the axial direction, and thus it is possible to suppress combustion oscillation while maintaining symmetry of the arrangement of the main burners.

(9) In some embodiments, in the above configuration (7) or (8), the pilot nozzle may include a plurality of swirlers spaced from each other and arranged on an outer periphery of the pilot nozzle along the circumferential direction, each of the swirlers extending outward in the radial direction. The swirlers may have different heights at different positions in the circumferential direction.

With the above configuration (9), varying heights of the swirlers of the pilot nozzle in the circumferential direction creates a non-uniform flow field with respect to the axial direction, which enables dispersion of the flame holding position. Accordingly, it is possible to reduce an average of maximum heating values and suppress combustion oscillation due to concentrated heat release in the vicinity of the fuel nozzle, while maintaining symmetry of the arrangement of the main burners.

(10) In some embodiments, in any one of the above configurations (6) to (9), the gas turbine combustor may further comprise an extension tube disposed to surround the pilot burner and partitioning between the pilot burner and the main burners. The extension tube may include: a second cylindrical portion covering the cylindrical portion of the pilot cone and at least a part of the pilot burner; and a second widened portion extending so as to widen downstream from a downstream end of the second cylindrical portion and surrounding the widened portion and the annular portion of the pilot cone.

With the above configuration (10), without changing the arrangement of the extension tube and the main burners disposed around the extension tube, it is possible to disperse the flame position mainly by the arrangement and the configuration of the pilot nozzle or the pilot cone disposed inside the extension tube.

(11) According to at least one embodiment of the present disclosure, a gas turbine engine comprises: a compressor for compressing air; the gas turbine combustor described in any one of the above (1) to (10) for injecting a fuel to the air compressed by the compressor and combusting the fuel; and a gas turbine configured to be driven by expansion of a combustion gas injected from the gas turbine combustor.

With the configuration (11), the flame holding position at different sites in the circumferential direction can be dispersed in the axial direction. Thus, it is possible to obtain the gas turbine engine including the gas turbine combustor which can prevent the flame holding position from concentrating on a certain position in the axial direction and suppress combustion oscillation.

According to at least one embodiment of the present invention, it is possible to prevent the occurrence of combustion oscillation while maintaining symmetry of main burners.

BRIEF DESCRIPTION OF DRAWINGS

FIG. 6 are a cross-sectional side view of an exemplary configuration of a gas turbine combustor according to another embodiment.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

For instance, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

On the other hand, an expression such as "comprise", "include", "have", "contain" and "constitute" are not intended to be exclusive of other components.

Figure 1:
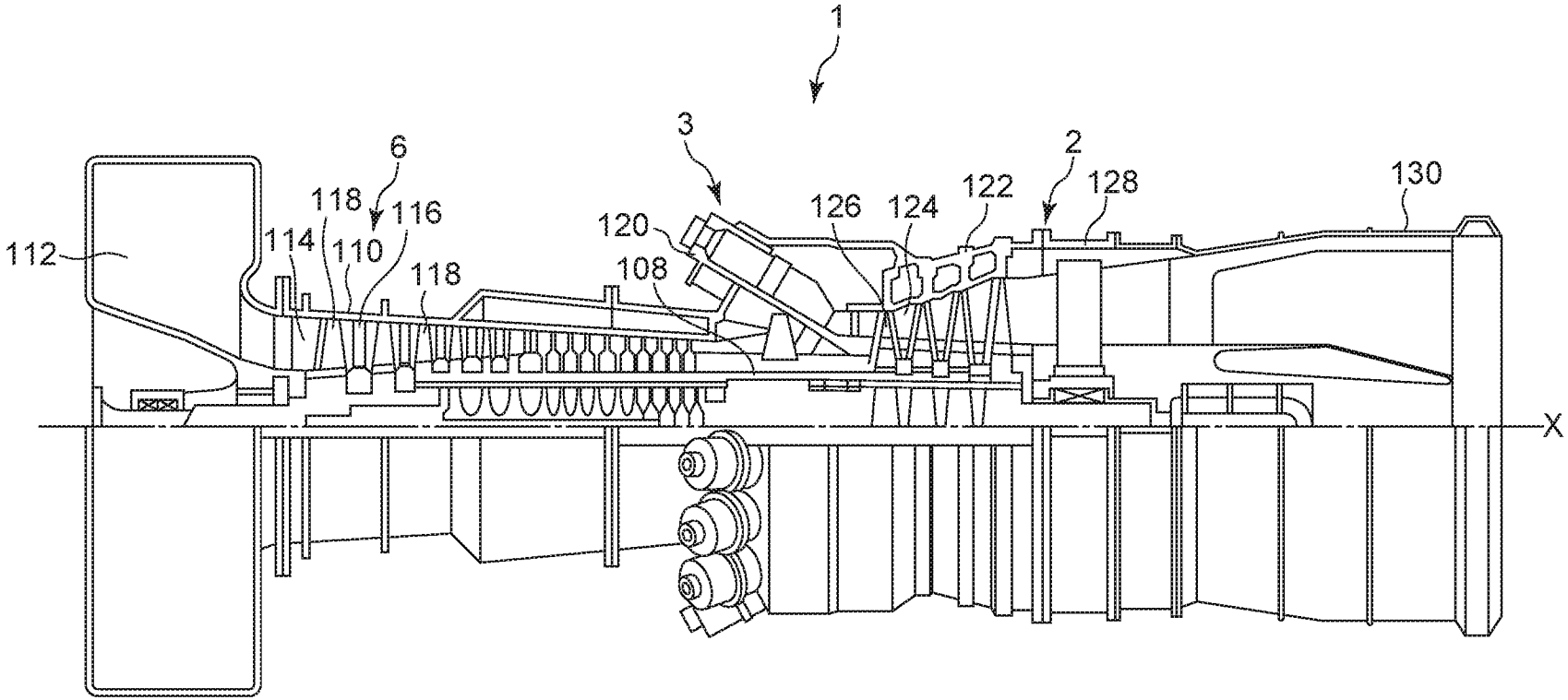
FIG. 1 is a schematic view of an exemplary configuration of a gas turbine engine according to an embodiment.

FIG. 1 is a schematic view of an exemplary configuration of a gas turbine engine according to an embodiment.

As illustrated in, but not limited to, FIG. 1, the gas turbine engine 1 according to at least one embodiment of the present disclosure includes a compressor 6 for compressing air which serves as an oxidant, a gas turbine combustor 3 for injecting a fuel to the air compressed by the compressor 6 and combusting the fuel, described in any one of embodiments of the present disclosure, and a gas turbine 2 configured to be rotationally driven by expansion of combustion gas ejected from the gas turbine combustor 3. In case that the gas turbine engine 1 is used for power generation, a generator (not shown) is connected to the gas turbine 2, so that rotational energy of the gas turbine 2 generates electric power.

The configuration example of each component in the gas turbine engine 1 will be described specifically.

The compressor 6 includes a compressor casing 110, an air inlet 112 disposed on an inlet side of the compressor casing 110 for sucking in air, a rotor 108 disposed so as to penetrate both of the compressor casing 110 and a turbine casing 122 described below along a rotational axis X, and a variety of blades disposed in the compressor casing 110. The variety of blades includes an inlet guide vane 114 disposed adjacent to the air inlet 112, a plurality of stator vanes 116 fixed to the compressor casing 110, and a plurality of rotor blades 118 implanted on the rotor 108 so as to be arranged alternately with the stator vanes 116. The compressor 6 may include other components not shown in the drawings, such as an extraction chamber. In the compressor 6, the air sucked in from the air inlet 112 flows through the plurality of stator vanes 116 and the plurality of rotor blades 118 to be compressed into compressed air having a high temperature and a high pressure. The compressed air having a high temperature and a high pressure is sent to the gas turbine combustor 3 of a latter stage from the compressor 6.

The gas turbine combustor 3 is disposed in a casing 120. As shown in FIG. 1, a plurality of gas turbine combustors 3 may be arranged annually around the rotor 108 inside the casing 120. The gas turbine combustor 3 is supplied with fuel and the compressed air produced in the compressor 6, and combusts the fuel to produce combustion gas that serves as a working fluid of the gas turbine 2. The combustion gas is sent to the gas turbine 2 at a latter stage from the gas turbine combustor 3. The configuration example of the gas turbine combustor 3 will be described later in detail.

The gas turbine 2 includes a turbine casing 122 and a variety of blades disposed inside the turbine casing 122. The variety of blades includes a plurality of stator vanes 124 fixed to the turbine casing 122 and a plurality of rotor blades 126 implanted on the rotor 108 so as to be arranged alternately with the stator vanes 124. The gas turbine 2 may include other components, such as an outlet guide vane. In the gas turbine 2, the rotor 108 is rotationally driven as the combustion gas passes through the plurality of stator vanes 124 and the plurality of rotor blades 126. In this way, the generator connected to the rotor 108 is driven.

An exhaust chamber 130 is connected to the downstream side of the turbine casing 122 via an exhaust casing 128. The combustion gas having driven the gas turbine 2 passes through the exhaust casing 128 and the exhaust chamber 130 and then is discharged outside.

Figure 2:
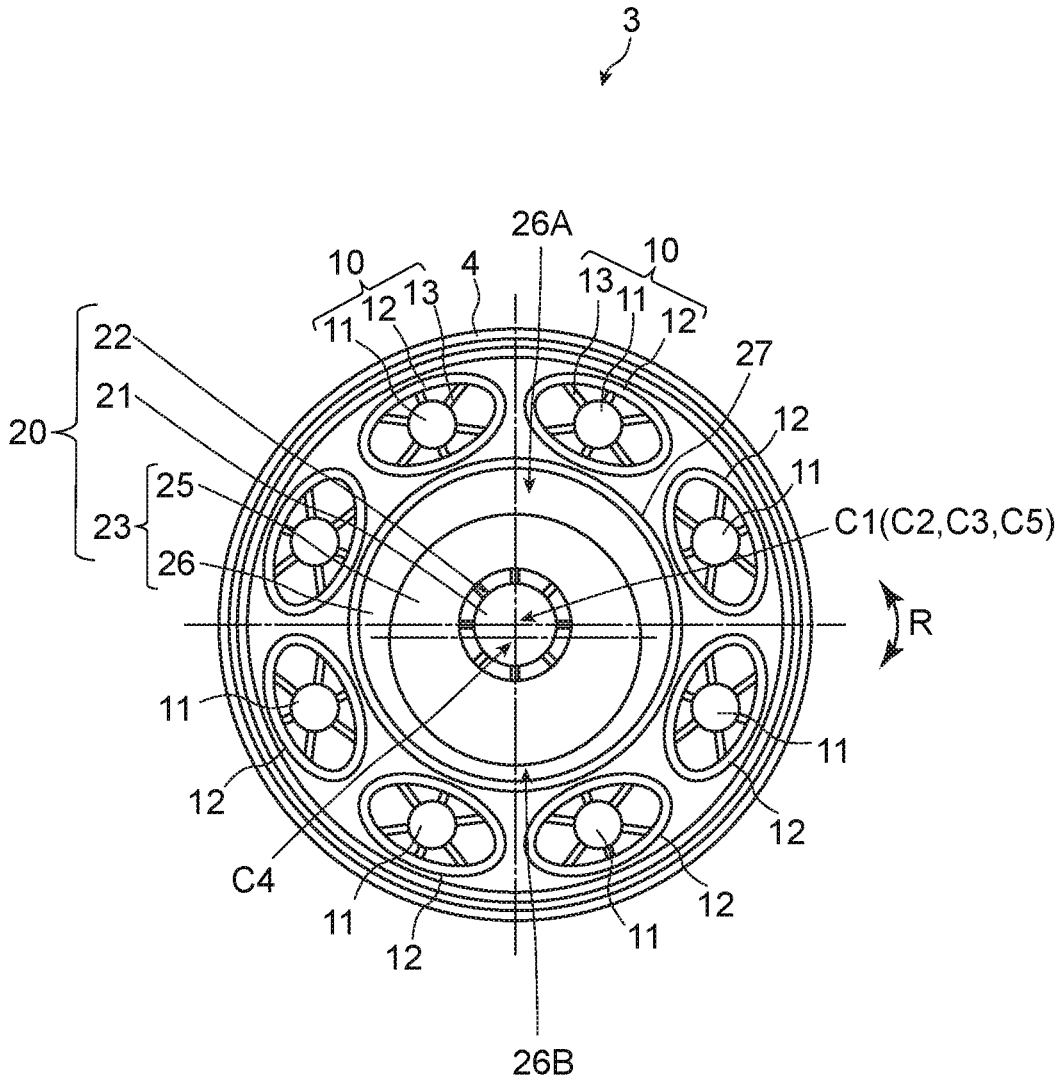
FIG. 2 is a front view of an exemplary configuration of a gas turbine combustor according to an embodiment.
Figure 3:
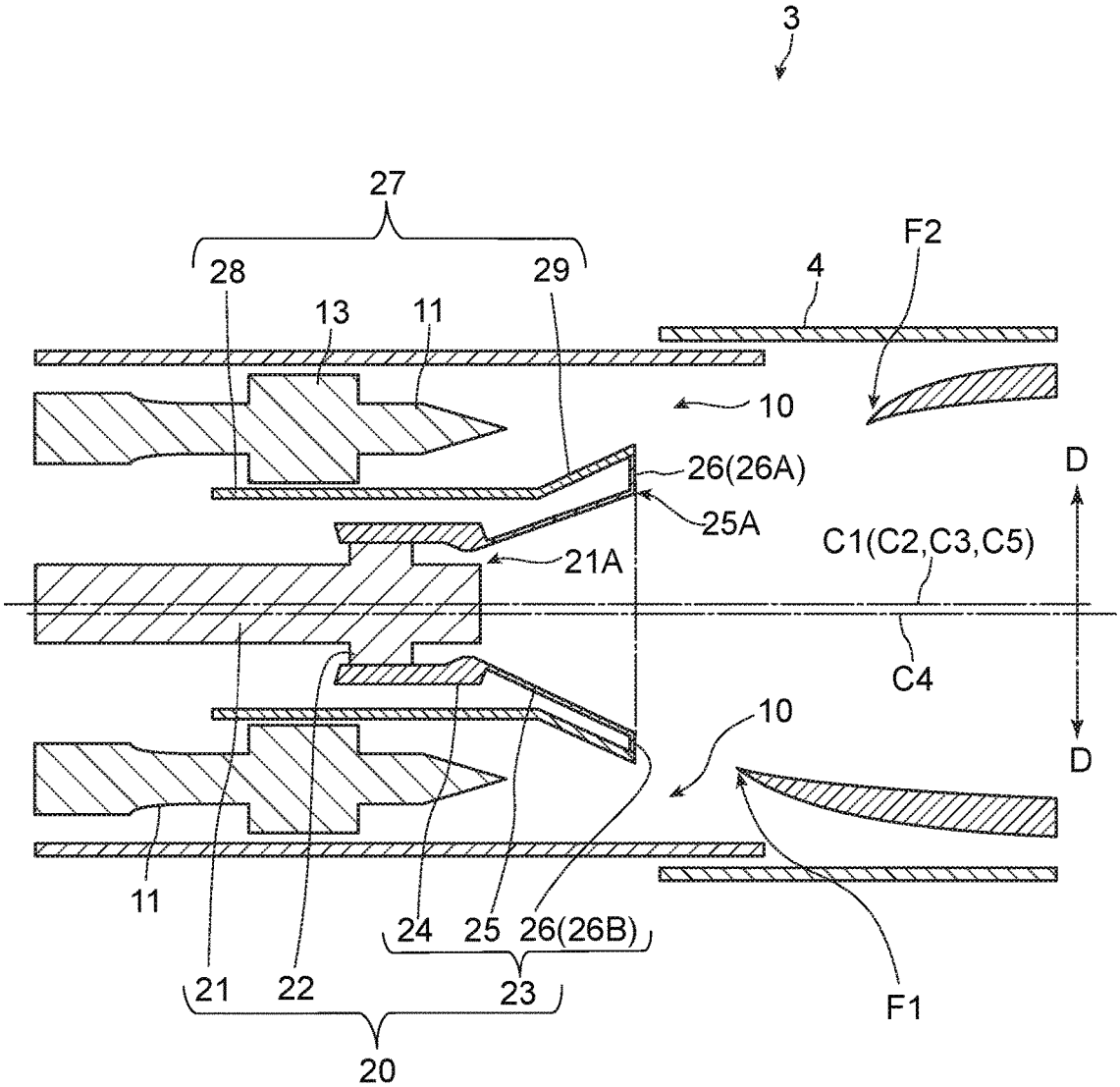
FIG. 3 is a cross-sectional side view of an exemplary configuration of a gas turbine combustor according to an embodiment.

Next, with reference to FIGS. 2 and 3, the specific configuration of the gas turbine combustor 3 according to an embodiment will be described. FIG. 2 is a front view of an exemplary configuration of a gas turbine combustor according to an embodiment. FIG. 3 is a cross-sectional side view of an exemplary configuration of a gas turbine combustor according to an embodiment.

As illustrated in, but not limited to, FIGS. 2 and 3, the gas turbine combustor 3 according to at least one embodiment of the present disclosure includes a pilot burner 20 disposed on a central portion of a combustion liner 4 and a plurality of main burners 10 (premixed combustion burners) surrounding the pilot burner 20. The gas turbine combustor 3 may include other components such as a bypass line (not shown) allowing the combustion gas to bypass.

The main burner 10 includes a main nozzle 11 connected to a fuel port (not shown), a main burner cylinder 12 disposed so as to surround the main nozzle 11, and a plurality of swirlers 13 spaced from each other and arranged along the outer periphery of the main nozzle 11.

The pilot burner 20 includes a pilot nozzle 21 disposed on the central portion of the combustion liner 4, and a pilot cone 23 including a widened portion 25 widening downstream from the vicinity of a downstream end 21A of the pilot nozzle 21, and an annular portion 26 having an annular shape extending radially outward from a downstream opening end 25A of the widened portion 25.

The annular portion 26 in at least one embodiment of the present disclosure includes a first position 26A in the circumferential direction and a second position 26B different from the first position 26A in the circumferential direction R, and the first position 26A and the second position 26B have different widths in the radial direction D of the combustion liner 4. For instance in FIGS. 2 and 3, in the annular portion 26, the first position 26A is a portion having a wider width in the radial direction D, and the second position 26B is a portion having a narrower width in the radial direction D than the first position 26A. The magnitude relationship of the widths between the first position 26A and the second position 26B may be inverse. As long as at least one pair of the first position 26A and the second position 26B having different widths are provided at any position in the circumferential direction R, portions having the same width in the radial direction D may exist in the circumferential direction R of the annular portion 26.

With the above configuration, since the width of the annular portion 26 of the pilot cone 23 in the radial direction varies between the first position 26A and the second position 26B in the circumferential direction, a mixture position where pilot flame injected from the pilot nozzle 21 and guided downstream along the inner periphery of the pilot cone 23 is mixed with main fuel injected from the main burner 10 varies in the direction of the central axis C1 of the combustion liner 4, depending on the width of the annular portion 26. That is, if the width of the annular portion 26 is wide (e.g. first position 26A), pilot flame and main fuel are mixed at a more downstream position (e.g., flame holding position F2 shown in FIG. 3); and if the width of the annular portion 26 is narrow (e.g. second position 26B), pilot flame and main fuel are mixed at a more upstream position (e.g., flame holding position F1 shown in FIG. 3).

Figure 4:
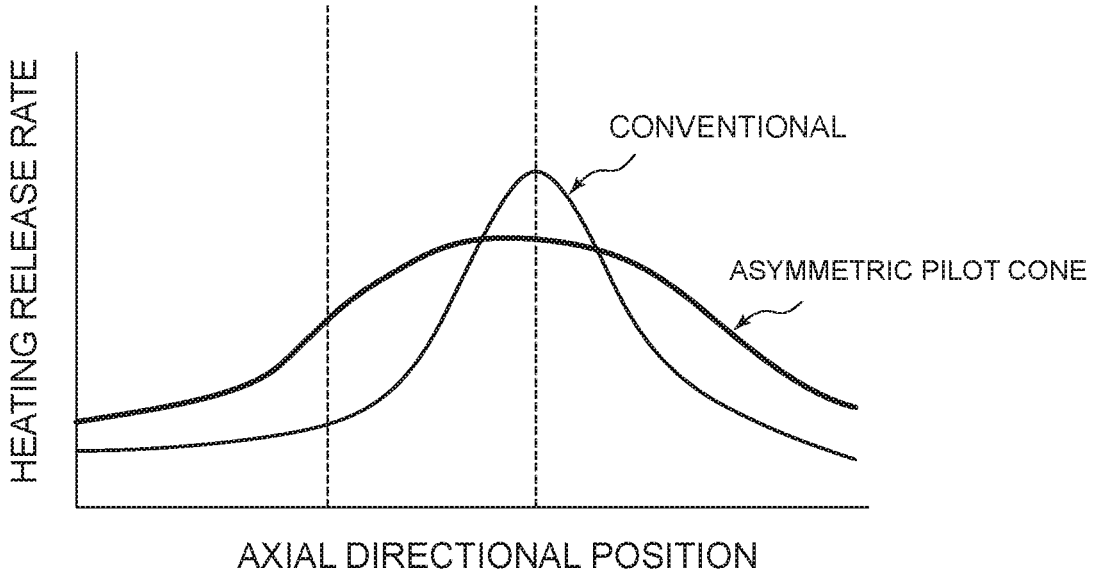
FIG. 4 is a diagram which compares an axial directional position and a heat release rate between a conventional gas turbine combustor and a gas turbine combustor according to an embodiment.

FIG. 4 is a diagram which compares an axial directional position and a heat release rate between a conventional gas turbine combustor and a gas turbine combustor according to an embodiment. As shown in FIG. 4, with the above configuration, the flame holding position at different sites (phases) in the circumferential direction R of the combustion liner 4 can be dispersed in the direction of the central axis C1 of the combustion liner 4. Thus, it is possible to prevent the flame holding position from concentrating on a certain position in the direction of the central axis C1. Consequently, it is possible to suppress combustion oscillation while maintaining symmetry of the main burners 10 with respect to the combustion liner 4.

As illustrated in, but not limited to, FIGS. 2 and 3, in some embodiments, in the above configuration, both the outer periphery and the inner periphery of the annular portion 26 of the pilot cone 23 may be circular, and the pilot cone 23 may be disposed so that the center C5 of the outer periphery of the annular portion 26 coincides with the central axis C1 of the combustion liner 4, and the center C4 of the inner periphery of the annular portion 26 deviates from the central axis C1 of the combustion liner 4.

Thus, when the inner periphery of the annular portion 26 is eccentric with respect to the outer periphery of the annular portion 26 which is concentric with the central axis C1 of the combustion liner 4, the width of the annular portion 26 varies with position in the circumferential direction R, which enables dispersion of the flame holding position in the direction of the central axis C1. Accordingly, it is possible to suppress combustion oscillation while maintaining symmetry of the main burners 10.

In the above configuration, the central axis C2 of the pilot nozzle 21 may coincide with the central axis C1 of the combustion liner 4. Additionally, the pilot cone 23 may include a cylindrical portion 24 disposed around the pilot nozzle 21 and extending upstream from an upstream end of the widened portion 25, and the center C3 of the cylindrical portion 24 may coincide with the center C1 of the combustion liner 4.

Figure 5:
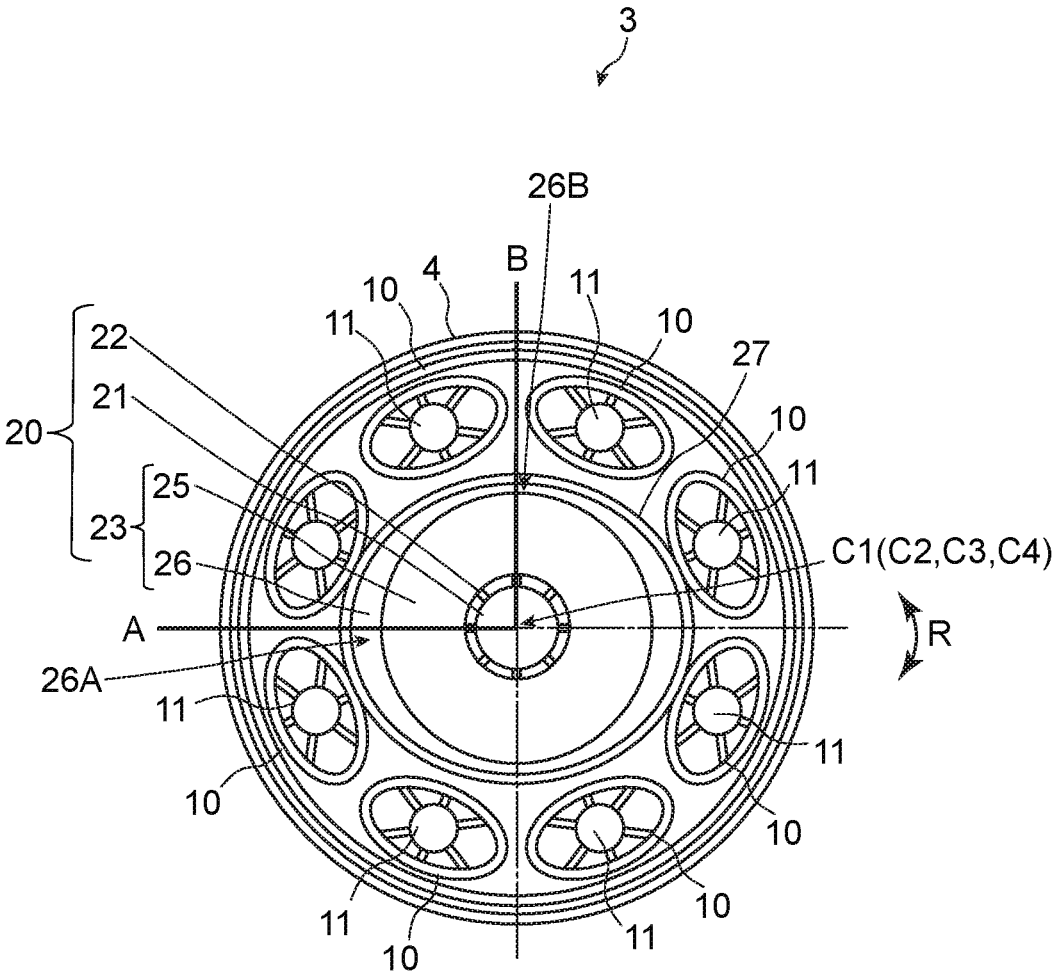
FIG. 5 is a front view of an exemplary configuration of a gas turbine combustor according to another embodiment.
Figure 6A:
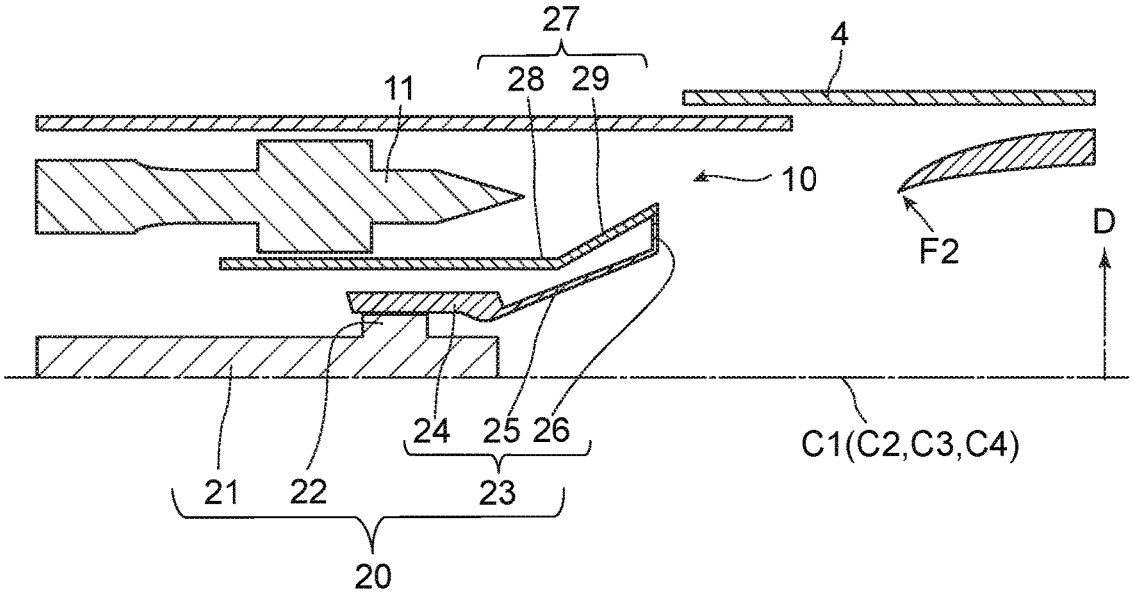
FIG. 6A shows cross-section A.
Figure 6B:
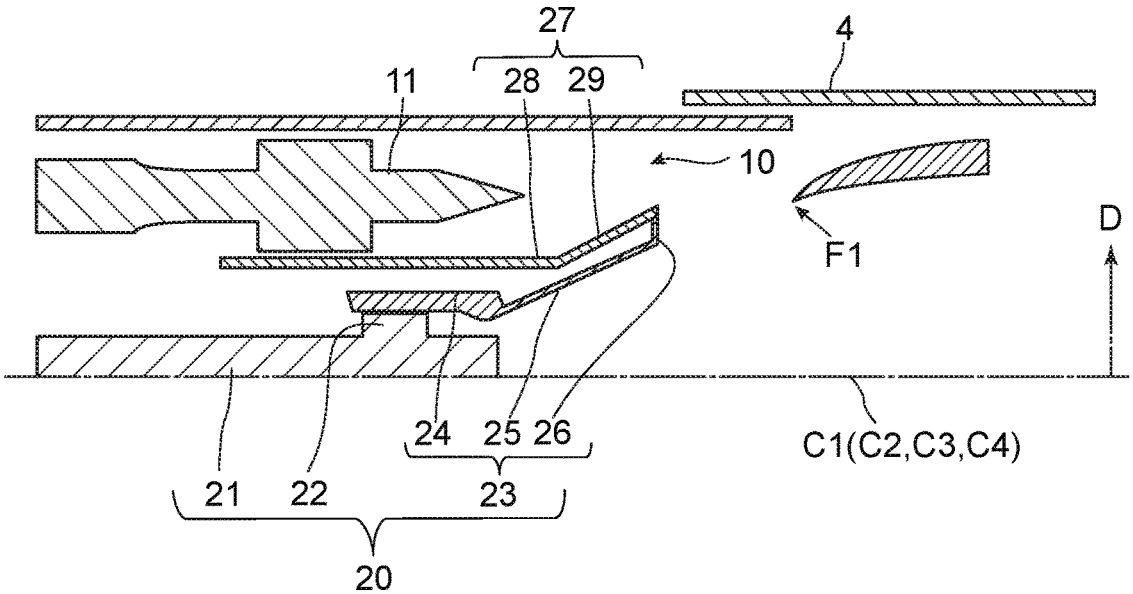
FIG. 6B shows cross-section B.

FIG. 5 is a front view of an exemplary configuration of a gas turbine combustor according to another embodiment. FIG. 6 is a cross-sectional side view of an exemplary configuration of a gas turbine combustor according to another embodiment.

As illustrated in, but not limited to, FIGS. 5 and 6, in some embodiments, in the above configuration, at least the outer periphery of the annular portion 26 of the pilot cone 23 may be elliptical when viewed from the direction of the central axis C1 of the combustion liner 4 so that the width of the annular portion 26 in the radial direction D varies in the circumferential direction R.

Thus, when at least the outer periphery of the annular portion 26 is elliptical when viewed from the direction of the central axis C1 of the combustion liner 4, the width of the annular portion 26 varies in the circumferential direction R, and the flame holding position is dispersed in the direction of the central axis C1. Accordingly, it is possible to suppress combustion oscillation while maintaining symmetry of the main burners 10.

In the above configuration, the central axis C2 of the pilot nozzle 21 may coincide with the central axis C1 of the combustion liner 4. Additionally, the center C3 of the cylindrical portion 24 of the pilot cone 23 may coincide with the central axis C1 of the combustion liner 4.

Figure 7:
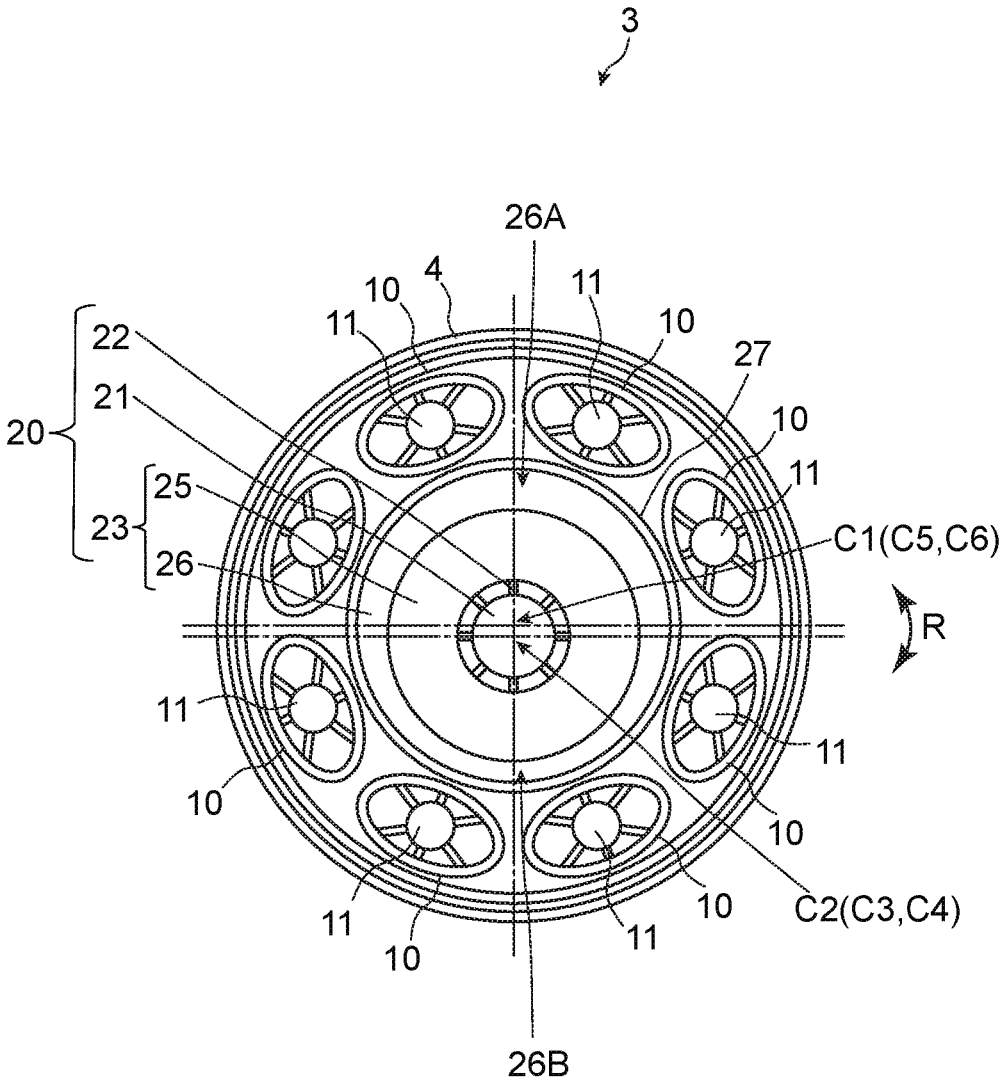
FIG. 7 is a front view of an exemplary configuration of a gas turbine combustor according to another embodiment.
Figure 8:
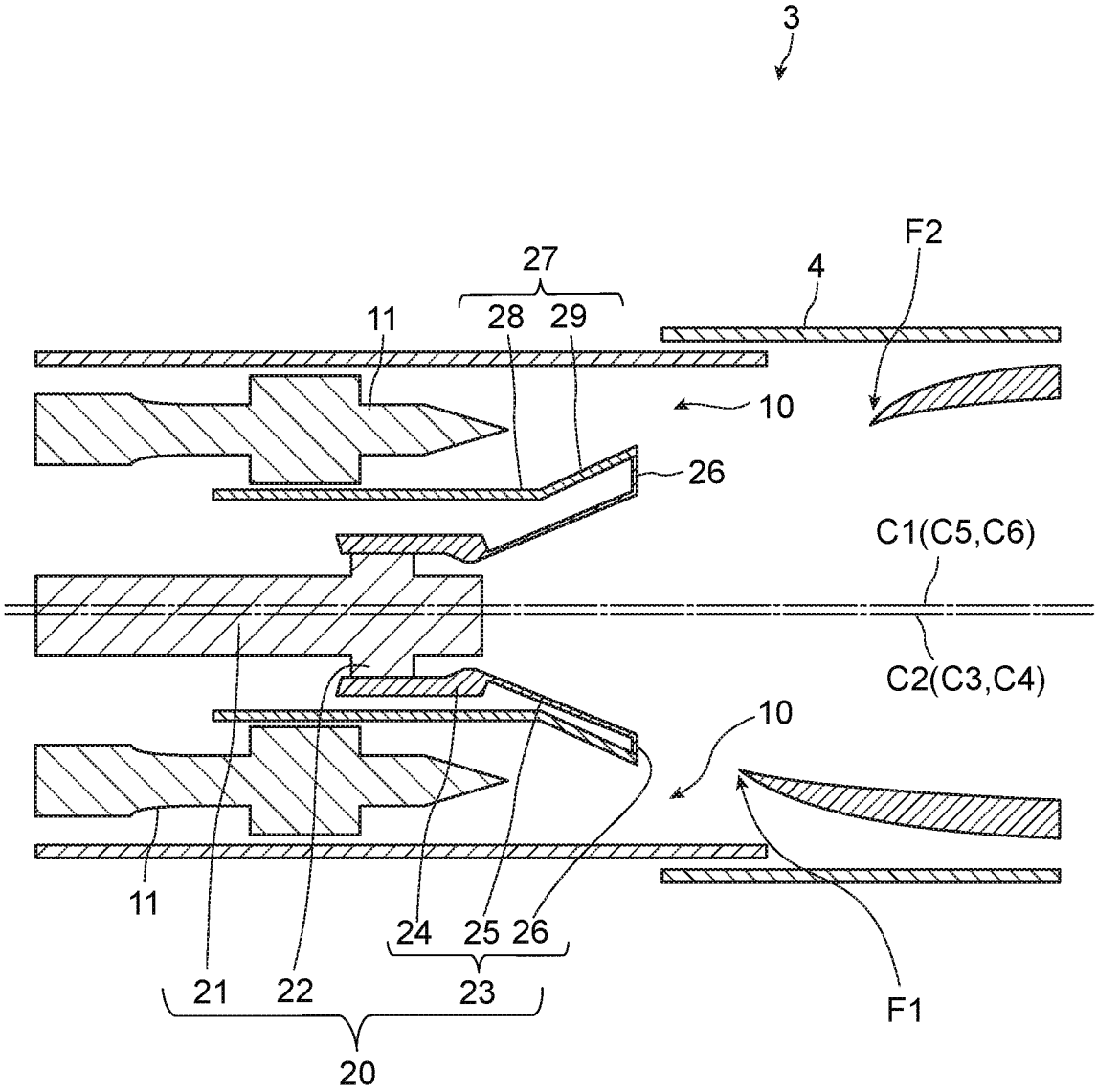
FIG. 8 is a side cross-sectional view of an exemplary configuration of a gas turbine combustor according to another embodiment.

FIG. 7 is a front view of an exemplary configuration of a gas turbine combustor according to another embodiment. FIG. 8 is a cross-sectional side view of an exemplary configuration of a gas turbine combustor according to another embodiment.

As illustrated in, but not limited to, FIGS. 7 and 8, in some embodiments, in any one of the above embodiments, the central axis C2 of the pilot nozzle 21 may deviate from the central axis C1 of the combustion liner 4, and the pilot cone 23 may be disposed so that the center C5 of the outer periphery of the annular portion 26 coincides with the central axis C1 of the combustion liner 4, and the center C4 of the inner periphery of the annular portion 26 deviates from the central axis C1 of the combustion liner 4.

Thus, when the center C5 of the outer periphery of the annular portion 26 coincides with the central axis C1 of the combustion liner 4, and the center C4 of the inner periphery of the annular portion 26 deviates from the central axis C1 of the combustion liner 4, the width of the annular portion 26 varies in the circumferential direction R, and the flame holding position is dispersed in the direction of the central axis C1. Accordingly, it is possible to suppress combustion oscillation while maintaining symmetry of the main burners 10.

In some embodiments, in the above configuration, the center C4 of the inner periphery of the annular portion 26 may coincide with the center C2 of the pilot nozzle 21. Additionally, the center C3 of the cylindrical portion 24 of the pilot cone 23 may coincide with the center C2 of the pilot nozzle 21 (see FIGS. 7 and 8).

Also with this configuration, it is possible to suppress combustion oscillation while maintaining symmetry of the main burners 10.

Figure 9:
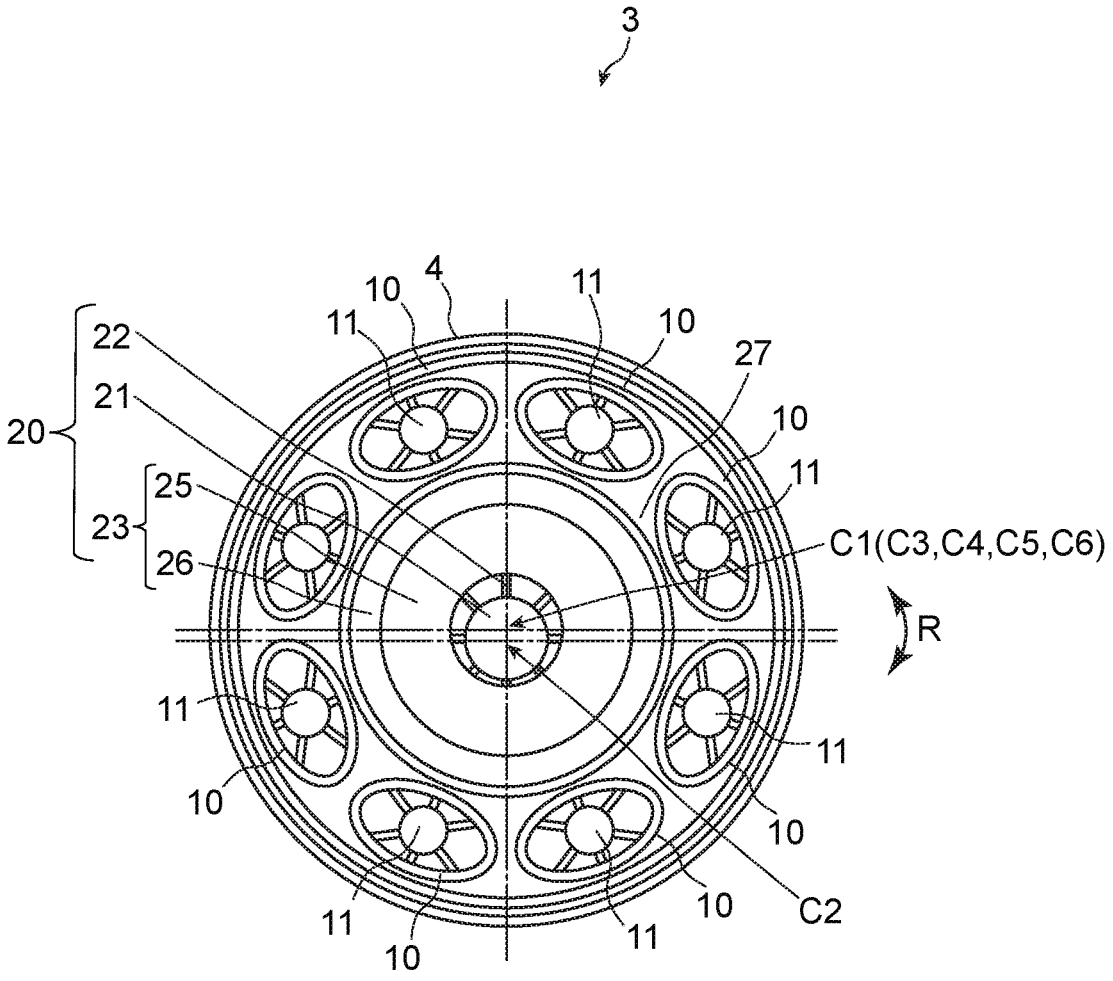
FIG. 9 is a front view of an exemplary configuration of a gas turbine combustor according to another embodiment.
Figure 10:
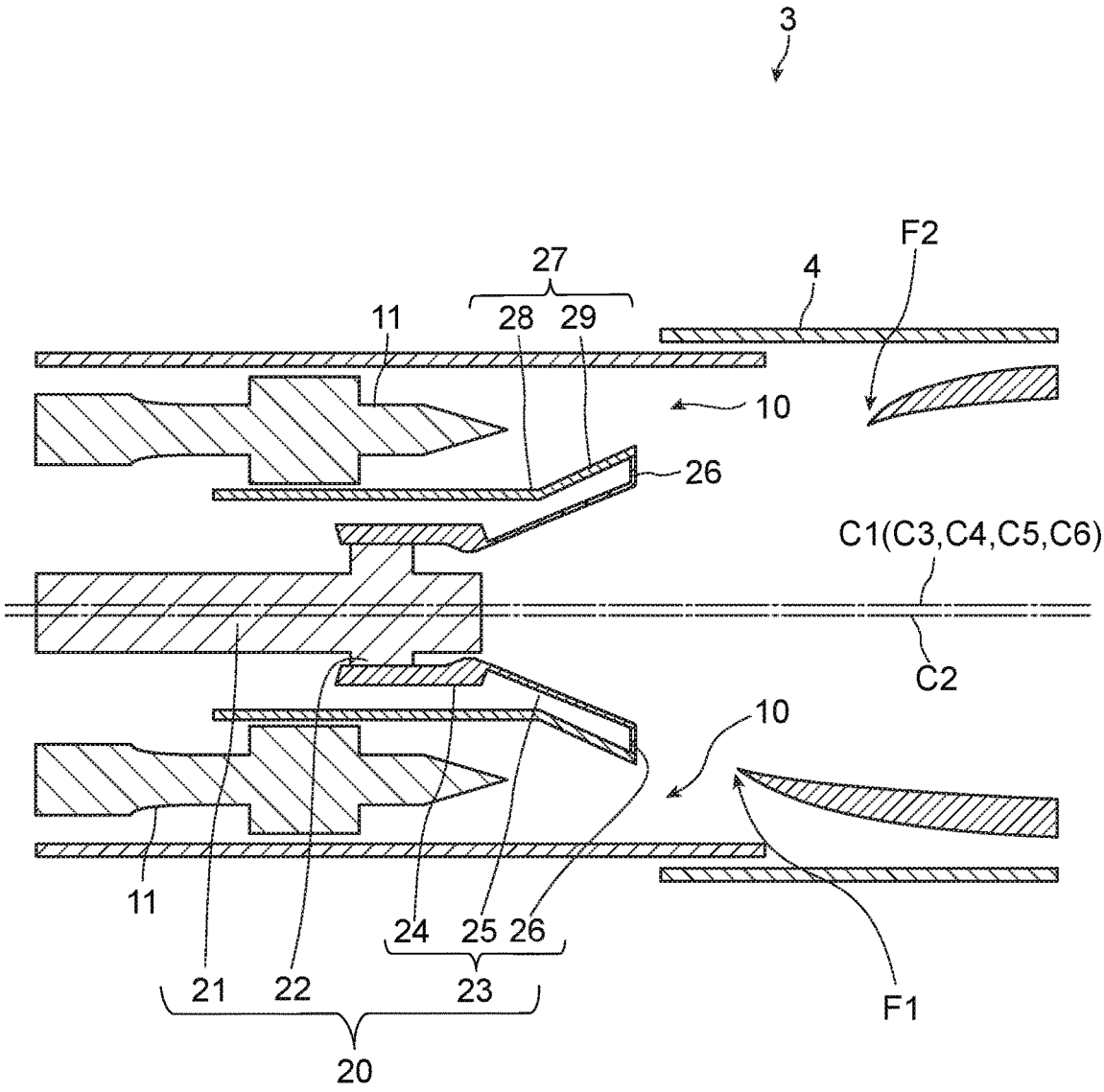
FIG. 10 is a side cross-sectional view of an exemplary configuration of a gas turbine combustor according to another embodiment.

FIG. 9 is a front view of an exemplary configuration of a gas turbine combustor according to another embodiment. FIG. 10 is a cross-sectional side view of an exemplary configuration of a gas turbine combustor according to another embodiment.

As illustrated in, but not limited to, FIGS. 9 and 10, in some embodiments, the center C2 of the pilot nozzle 21 may deviate from the center C3 of the cylindrical portion 24 of the pilot cone 23.

Thus, when the pilot nozzle 21 is disposed eccentrically with respect to the cylindrical portion 24 disposed upstream of the widened portion 25, fuel injected from the pilot nozzle 21 is guided asymmetrically to the inner periphery of the widened portion 25 and mixed with fuel injected from each main nozzle 11 at an asymmetric position with respect to the central axis C1 of the combustion liner 4. Accordingly, it is possible to disperse the flame holding position around the central axis C and in the direction of the central axis C1, and thus it is possible to suppress combustion oscillation while maintaining symmetry of the main burners 10.

In the above configuration, the center C3 of the cylindrical portion 24 may coincide with the central axis C1 of the combustion liner 4 (see FIGS. 9 and 10). Additionally, the center C4 of the inner periphery and the center C5 of the outer periphery of the annular portion 26 may coincide with the central axis C1 of the combustion liner 4 (FIGS. 9 and 10).

In some embodiments, the center C3 of the cylindrical portion 24 of the pilot cone 23 may coincide with the central axis C1 of the combustion liner 4 (see FIGS. 9 and 10).

With this configuration, the center C2 of the pilot nozzle 21 which is eccentric with respect to the center C3 of the cylindrical portion 24 deviates from the central axis C1 of the combustion liner 4. Thus, fuel injected from the pilot nozzle 21 is guided asymmetrically to the inner periphery of the widened portion 25 and mixed with fuel injected from each main nozzle 11, at an asymmetric position with respect to the central axis C1 of the combustion liner 4. Accordingly, it is possible to disperse the flame holding position around the central axis C and in the direction of the central axis C1, and thus it is possible to suppress combustion oscillation while maintaining symmetry of the main burners 10.

Figure 11:
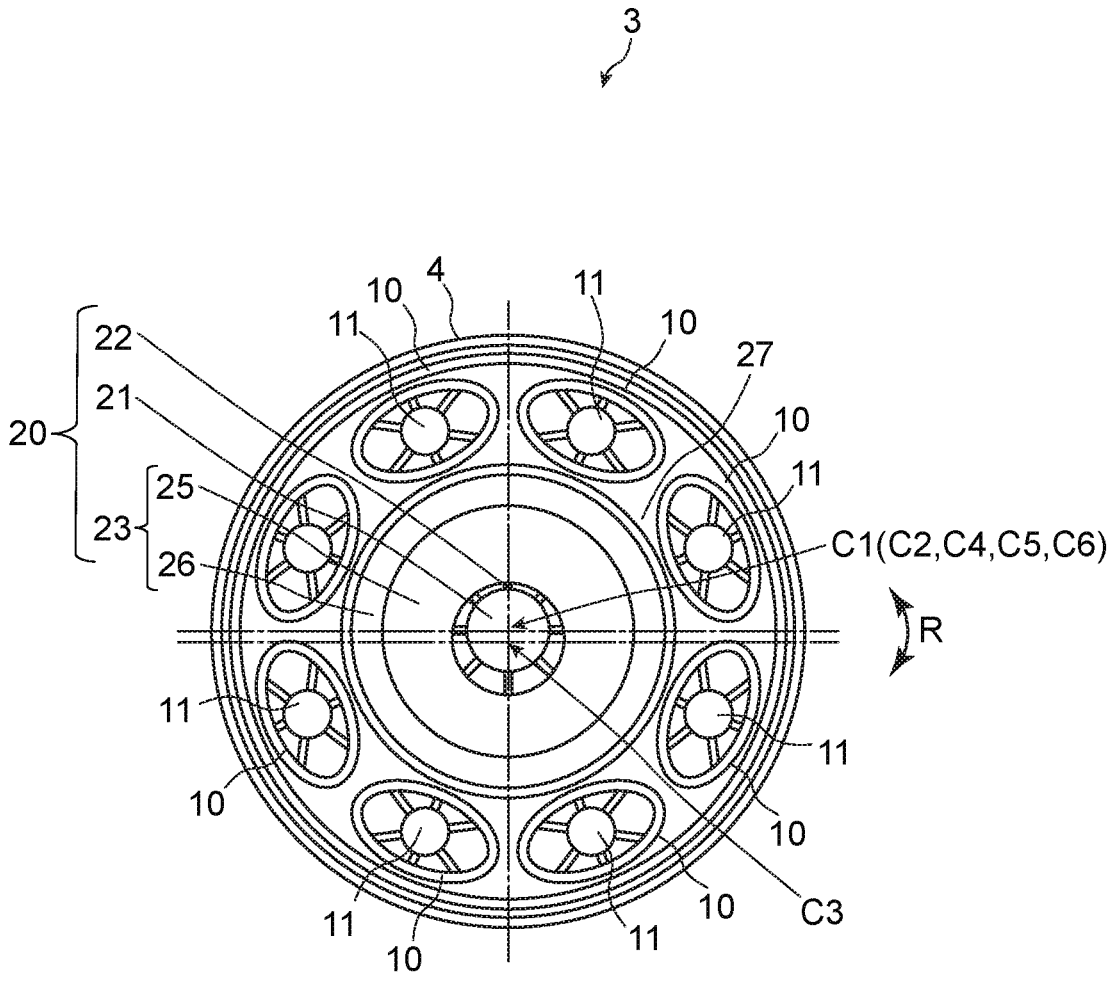
FIG. 11 is a front view of an exemplary configuration of a gas turbine combustor according to another embodiment.
Figure 12:
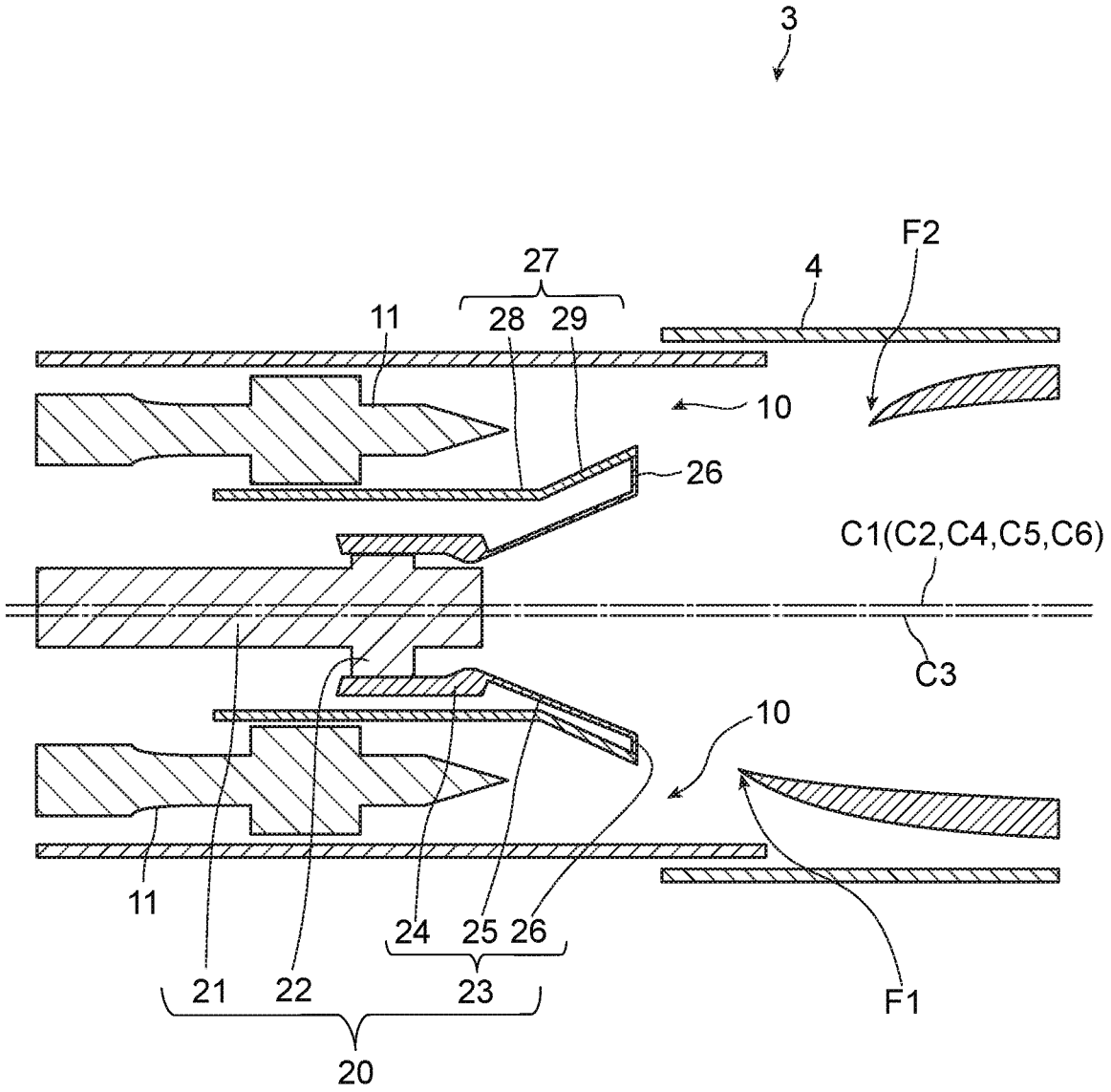
FIG. 12 is a side cross-sectional view of an exemplary configuration of a gas turbine combustor according to another embodiment.

FIG. 11 is a front view of an exemplary configuration of a gas turbine combustor according to another embodiment. FIG. 12 is a cross-sectional side view of an exemplary configuration of a gas turbine combustor according to another embodiment.

As illustrated in, but not limited, FIGS. 11 and 12, in some embodiments, in any one of the above configurations, the central axis C2 of the pilot nozzle 21 may coincide with the central axis C1 of the combustion liner 4.

In this case, at least the center C3 of the cylindrical portion 24 of the pilot cone 23 deviates from the center C2 of the pilot nozzle 21 which is concentric with the central axis C1 of the combustion liner 4. Thus, fuel injected from the pilot nozzle 21 is guided asymmetrically to the inner periphery of the widened portion 25 and mixed with fuel injected from each main nozzle 11, at an asymmetric position with respect to the central axis C1 of the combustion liner 4. Accordingly, it is possible to disperse the flame holding position around the central axis C and in the direction of the central axis C1, and thus it is possible to suppress combustion oscillation while maintaining symmetry of the main burners 10.

In some embodiments, for instance as illustrated in, but not limited to, FIGS. 9 to 12, the pilot nozzle 21 includes a plurality of swirlers 22 spaced from each other and arranged on the outer periphery along the circumferential direction R so as to each extend outward in the radial direction D. The swirlers 22 may be formed to have different heights at different positions in the circumferential direction R.

With this configuration, varying heights of the swirlers 22 of the pilot nozzle 21 in the circumferential direction R creates a non-uniform flow field with respect to the direction of the central axis C1, which enables dispersion of the flame holding position. Accordingly, it is possible to reduce an average of maximum heating values and suppress combustion oscillation due to concentrated heat release in the vicinity of the fuel nozzle, while maintaining symmetry of the main burners 10.

In some embodiments, in any one of the above configurations, the gas turbine combustor may further include an extension tube 27 disposed to surround the pilot burner 20 and partitioning between the pilot burner 20 and the main burners 10. The extension tube 27 includes a second cylindrical portion 28 covering the cylindrical portion 24 and at least a part of the pilot burner 20 and a second widened portion 29 extending so as to widen downstream from a downstream end of the second cylindrical portion 28 and surrounding the widened portion 25 and the annular portion 26 (see FIGS. 3, 6, 8, 10, and 12).

With this configuration, without changing the arrangement of the extension tube 27 and the main burners 10 disposed around the extension tube 27, it is possible to disperse the flame position mainly by the arrangement and the configuration of the pilot nozzle 21 or the pilot cone 23 disposed inside the extension tube 27.

The center C6 of a downstream opening end of the extension tube 27 may coincide with the central axis C1 of the combustion liner 4 and/or the center C5 of the outer periphery of the annular portion 26 (see FIGS. 7 to 12).

With the configuration described above, the flame holding position at different sites in the circumferential direction R of the combustion liner 4 can be dispersed in the direction of the central axis C1 of the combustion liner 4. Thus, it is possible to obtain the gas turbine engine 1 including the gas turbine combustor 3 which can prevent the flame holding position from concentrating on a certain position in the direction of the central axis C1 and suppress combustion oscillation.

As described above, according to some embodiments of the present disclosure, it is possible to prevent the occurrence of combustion oscillation while maintaining symmetry of main burners.

Embodiments of the present invention were described in detail above, but the present invention is not limited thereto, and various amendments and modifications may be implemented.

The gas turbine combustor 3 according to at least one embodiment of the present invention includes a pilot burner 20 disposed on a central portion of a combustion liner 4, a plurality of main burners 10 disposed to surround the pilot burner 20. The pilot burner 20 includes a pilot nozzle 21 disposed on the central portion of the combustion liner 4 and a pilot cone 23. The pilot cone 23 includes a widened portion 25 widening downstream from the vicinity of a downstream end of the pilot nozzle 21, and an annular portion 26 having an annular shape extending outward in the radial direction D from a downstream opening end of the widened portion 25. The annular portion 26 includes a first position in the circumferential direction and a second position different from the first position in the circumferential direction R, and the first position and the second position have different widths in the radial direction D. The pilot cone 23 includes a cylindrical portion 24 disposed around the pilot nozzle 21 and extending upstream from an upstream end of the widened portion 25. The pilot nozzle 21 is eccentric with respect to the cylindrical portion 24.

The invention claimed is:

1. A gas turbine combustor comprising:

a pilot burner disposed on a central portion of a combustion liner; and a plurality of main burners disposed to surround the pilot burner, wherein the pilot burner includes:

a pilot nozzle disposed on the central portion of the combustion liner; and a pilot cone including a widened portion widening downstream away from a downstream end of the pilot nozzle, and an annular portion having an annular shape extending outward in a radial direction from a downstream opening end of the widened portion, and wherein:

the annular portion includes a first position in a circumferential direction and a second position different from the first position in the circumferential direction, and the first position and the second position have different widths in the radial direction; and a center of an outer periphery of the annular portion of the pilot cone coincides with a central axis of the combustion liner, and a center of an inner periphery of the annular portion deviates from the central axis of the combustion liner.

2. A gas turbine combustor comprising:

a pilot burner disposed on a central portion of a combustion liner; and a plurality of main burners disposed to surround the pilot burner, wherein the pilot burner includes:

a pilot nozzle disposed on the central portion of the combustion liner; and a pilot cone including a widened portion widening downstream away from a downstream end of the pilot nozzle, and an annular portion having an annular shape extending outward in a radial direction from a downstream opening end of the widened portion, and wherein:

the annular portion includes a first position in a circumferential direction and a second position different from the first position in the circumferential direction, and the first position and the second position have different widths in the radial direction; and at least an outer periphery of the annular portion of the pilot cone is elliptical when viewed from a direction of a central axis of the combustion liner so that a width of the annular portion in the radial direction varies in the circumferential direction.

3. The gas turbine combustor according to claim 1, wherein the pilot nozzle is disposed eccentrically with respect to the central axis of the combustion liner.

4. The gas turbine combustor according to claim 3, wherein the inner periphery of the annular portion is concentric with the pilot nozzle.

5. A gas turbine combustor comprising:

a pilot burner disposed on a central portion of a combustion liner; and a plurality of main burners disposed to surround the pilot burner, wherein the pilot burner includes:

a pilot nozzle disposed on the central portion of the combustion liner; and a pilot cone including a widened portion widening downstream away from a downstream end of the pilot nozzle, and an annular portion having an annular shape extending outward in a radial direction from a downstream opening end of the widened portion, and wherein:

the annular portion includes a first position in a circumferential direction and a second position different from the first position in the circumferential direction, and the first position and the second position have different widths in the radial direction;

the pilot cone includes a cylindrical portion disposed around the pilot nozzle and extending upstream from an upstream end of the widened portion; and the pilot nozzle is disposed eccentrically with respect to the cylindrical portion.

6. The gas turbine combustor according to claim 5, wherein a center of the cylindrical portion of the pilot cone coincides with a central axis of the combustion liner.

7. The gas turbine combustor according to claim 6, wherein the pilot nozzle includes a plurality of swirlers spaced from each other and arranged on an outer periphery of the pilot nozzle along the circumferential direction, each of the swirlers extending outward in the radial direction, and wherein the swirlers have different heights at different positions in the circumferential direction.

8. The gas turbine combustor according to claim 5, wherein the pilot nozzle is disposed concentrically with a central axis of the combustion liner.

9. The gas turbine combustor according to claim 8, wherein the pilot nozzle includes a plurality of swirlers spaced from each other and arranged on an outer periphery of the pilot nozzle along the circumferential direction, each of the swirlers extending outward in the radial direction, and wherein the swirlers have different heights at different positions in the circumferential direction.

10. The gas turbine combustor according to claim 5, further comprising an extension tube disposed to surround the pilot burner and partition between the pilot burner and the main burners, wherein the cylindrical portion is a first cylindrical portion and the widened portion is a first widened portion, and wherein the extension tube includes:

a second cylindrical portion covering the first cylindrical portion of the pilot cone and at least a part of the pilot burner; and a second widened portion extending so as to widen downstream from a downstream end of the second cylindrical portion and surrounding the first widened portion and the annular portion of the pilot cone.

11. A gas turbine engine comprising:

a compressor for compressing air;

the gas turbine combustor according to claim 1 for injecting a fuel to the air compressed by the compressor and combusting the fuel; and a gas turbine configured to be driven by expansion of a combustion gas injected from the gas turbine combustor.

12. A gas turbine engine comprising:

a compressor for compressing air;

the gas turbine combustor according to claim 2 for injecting a fuel to the air compressed by the compressor and combusting the fuel; and a gas turbine configured to be driven by expansion of a combustion gas injected from the gas turbine combustor.

13. A gas turbine engine comprising:

a compressor for compressing air;

the gas turbine combustor according to claim 5 for injecting a fuel to the air compressed by the compressor and combusting the fuel; and a gas turbine configured to be driven by expansion of a combustion gas injected from the gas turbine combustor.

* * * * *